US006522751B1

(12) United States Patent
Iwase et al.

(10) Patent No.: US 6,522,751 B1
(45) Date of Patent: Feb. 18, 2003

(54) STEREOPHONIC SIGNAL PROCESSING APPARATUS

(75) Inventors: Hiroshi Iwase, Sagamihara (JP); Takahiro Kubota, Sagamihara (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/744,729

(22) PCT Filed: Jun. 19, 2000

(86) PCT No.: PCT/EP00/05641

§ 371 (c)(1),
(2), (4) Date: Jan. 29, 2001

(87) PCT Pub. No.: WO00/79838

PCT Pub. Date: Dec. 28, 2000

(30) Foreign Application Priority Data

Jun. 22, 1999 (JP) ..... 11-175980

(51) Int. Cl.[7] ..... H04R 5/00
(52) U.S. Cl. ..... 381/17; 381/1
(58) Field of Search ..... 381/17, 1, 61, 381/63

(56) References Cited

U.S. PATENT DOCUMENTS 5,970,153 A * 10/1999 Petroff ..... 381/17
5,995,631 A * 11/1999 Kamada et al. ..... 381/17

FOREIGN PATENT DOCUMENTS

JP 03297300 * 12/1991 ..... 381/17

* cited by examiner

*Primary Examiner*—Minsun Oh Harvey
(74) *Attorney, Agent, or Firm*—Edward W. Goodman

(57) ABSTRACT

A stereophonic signal processing apparatus, capable of reproducing sounds of musical instruments in high fidelity while effectively eliminating vocal signals, includes a right filter combination 121 and 122 for extracting a right low-frequency signal and a right high-frequency signal from a right input signal, a left filter combination 111 and 112 for extracting a left low-frequency signal and a left high-frequency signal from a left input signal, a subtraction circuit 131 for subtracting a right input signal and a left input signal and thereby generating a vocal elimination signal, a right addition circuit 123 for adding a right low-frequency signal and a right high-frequency signal from the right filter combination to a vocal elimination signal from the subtraction circuit and thereby generating a right output signal, a left addition circuit 113 for adding a left low-frequency signal and a left high-frequency signal from the left filter combination to a vocal elimination signal from the subtraction circuit and thereby generating a left output signal, and a controller 140 for changing characteristics of both of the right filter combination and the left filter combination according to at least one of a right input signal and a left input signal.

5 Claims, 6 Drawing Sheets

STEREOPHONIC SIGNAL PROCESSING APPARATUS

BACKGROUND OF THE INVENTION

1. Field of the Invention

The present invention relates to a stereophonic signal processing apparatus, and more particularly, to a stereophonic signal processing apparatus having a vocal cancel function to eliminate vocal signals included in left and right input signals.

2. Description of the Related Art

Conventionally, a circuit as shown in FIG. 6 is used to cancel vocal components (vocal signals) from left and right input stereophonic signals mixedly including vocal and instrumental plays and to obtain a instrumental play signal.

This circuit has a left low-pass filter 11 that extracts a left low-frequency signal and a left high-pass filter 12 that extracts a left high-frequency signal, from a left input signal (Lin), a right low-pass filter 21 that extracts a right low-frequency signal and a right high-pass filter 22 that extracts a right high-frequency signal, from a right input signal (Rin), subtraction means 31 that performs subtraction between the right input signal (Rin) and the left input signal (Lin) to generate a vocal elimination signal, left addition means 13 that adds the left low-frequency signal and the left high-frequency signal to the vocal elimination signal to generate a left output signal (Lout), and right addition means 23 that adds the right low-frequency signal and the right high-frequency signal to the vocal elimination signal to generate a right output signal (Rout).

First, the vocal elimination signal where the vocal signal precisely located around the center of the stereophonic signal is canceled, is generated by subtraction between the left input signal and the right input signal at equal ratio, by the subtraction means 31. In the vocal elimination signal, though the vocal signals are canceled, the signal components with different phases (play signals) from the left and right signals remain. Note that the vocal elimination signal is a monophonic signal.

Then, the left and right filters, having characteristics as shown in FIG. 7(*a*), respectively extract a low-frequency signal and a high-frequency signal except an intermediate frequency including a vocal signal in advance. The low-frequency signals and the high-frequency signals are stereophonic signals.

Then, from the vocal elimination signal as a monophonic signal, to obtain the stereo effect and to enhance the low-frequency and high-frequency regions, stereophonic signals, where all the frequencies are included and the vocal signals are eliminated, are generated by adding the left and right respective low-frequency signals and high-frequency signals.

In the above circuit, signals of musical instruments precisely located around the center of the stereophonic signals are deleted with the vocal signals by the subtraction, however, a sufficient level output can be obtained by passing the signals through the low-pass filter or high-pass filter (see FIG. 7A).

However, in a signal of an instrument having frequency components as shown in FIG. 7B, although the signal has frequency components from a fundamental f0 to f2, frequency components around the frequency component f1 are cut by the low-pass filter. That is, frequency components in the region A01 remain but frequency components in the region A12 are eliminated.

As these frequency components are eliminated, for example, an attack sound of an instrument, such as, a bass drum is changed to a base-like sound. That is, the sound of an original instrument changes as if it is a sound of another instrument.

Further, a similar phenomenon occurs around a cutoff frequency of the high-pass filter in the sound of an instrument having a peak around the frequency.

Then, to avoid the above problem, the characteristics of the low-pass filter or the high-pass filter may be milder. However, such arrangement has a new problem in that the vocal signal to be eliminated passes through the low-pass filter or the high-pass filter.

As a result, since it is necessary to place importance on the performance to eliminate the vocal signals, the change of instrumental sound is not especially considered.

SUMMARY OF THE INVENTION

Accordingly, the present invention has an object to realize a stereophonic signal processing apparatus capable of reproducing sounds of musical instruments while effectively eliminating vocal signals.

The invention is embodied in a stereophonic signal processing apparatus for eliminating vocal signals contained in right and left input signals, said apparatus comprising; right filter means for extracting a right low-frequency signal and a right high-frequency signal from a right input signal, left filter means for extracting a left low-frequency signal and a left high-frequency signal from a left input signal, a subtraction means for subtracting a right input signal and a left input signal and thereby generating a vocal elimination signal, a right addition means for adding a right low-frequency signal and a right high-frequency signal from said right filter means to a vocal elimination signal from said subtraction means and thereby generating a right output signal, a left addition means for adding a left low-frequency signal and a left high-frequency signal from said left filter means to a vocal elimination signal from said subtraction means and thereby generating a left output signal, and control means for changing characteristics of both of said right filter means and said left filter means according to at least one of a right input signal and a left input signal.

Note that it is desirable that the control means performs a control to reduce attenuation of signals other than the vocal signal contained in at least one of the right input signal and the left input signal by detecting a rising of a waveform of at least one of the right input signal and the left input signal or detecting a frequency component included in at least. one of the right input signal and the left input signal.

Thus, by changing both characteristics of the right filter means and the left filter means, the attenuation of instrumental sound by the filter means to enhance low-frequency and high-frequency regions can be reduced while the vocal signals are effectively eliminated, and reproduction in high fidelity can be made.

The invention is further embodied in a stereophonic signal processing apparatus for eliminating vocal signals contained in right and left input signals, said apparatus comprising; right filter means for extracting a right low-frequency signal and a right high-frequency signal from a right input signal, left filter means for extracting a left low-frequency signal and a left high-frequency signal from a right input signal, a subtraction means for subtracting a right input signal and a left input signal and thereby generating a vocal elimination signal, a right addition means for adding a right low-frequency signal and a right high-frequency signal from said right filter means to a vocal elimination signal from said subtraction means and thereby generating a right output signal, a left addition means for adding a left low-frequency signal and a left high-frequency signal from said left filter means to a vocal elimination signal from said subtraction means and thereby generating a left output signal, and control means for adjusting, in signal level, a right input signal and a left input signal to be subtracted by said subtraction means according to at least one of a right input signal and a left input signal.

Note that it is desirable that the control means performs a control to reduce attenuation of signals other than the vocal signal contained at least one of the right input signal and the left input signal by detecting a rising of a waveform of at least one of the right input signal and the left input signal or detecting a frequency component contained in at least one of the right input signal and the left input signal.

By adjusting signal levels before subtraction by the subtraction means, the attenuation of instrumental sound by the subtraction means can be reduced, and reproduction in high fidelity can be made.

DESCRIPTION OF THE PREFERRED EMBODIMENTS

Hereinbelow, embodiments of the present invention will be described in detail. Note that in the present embodiments, description will be made using a stereophonic signal processing apparatus having a vocal cancel function to remove vocal signals included in left and right input signals as a particular example.

Figure 1:
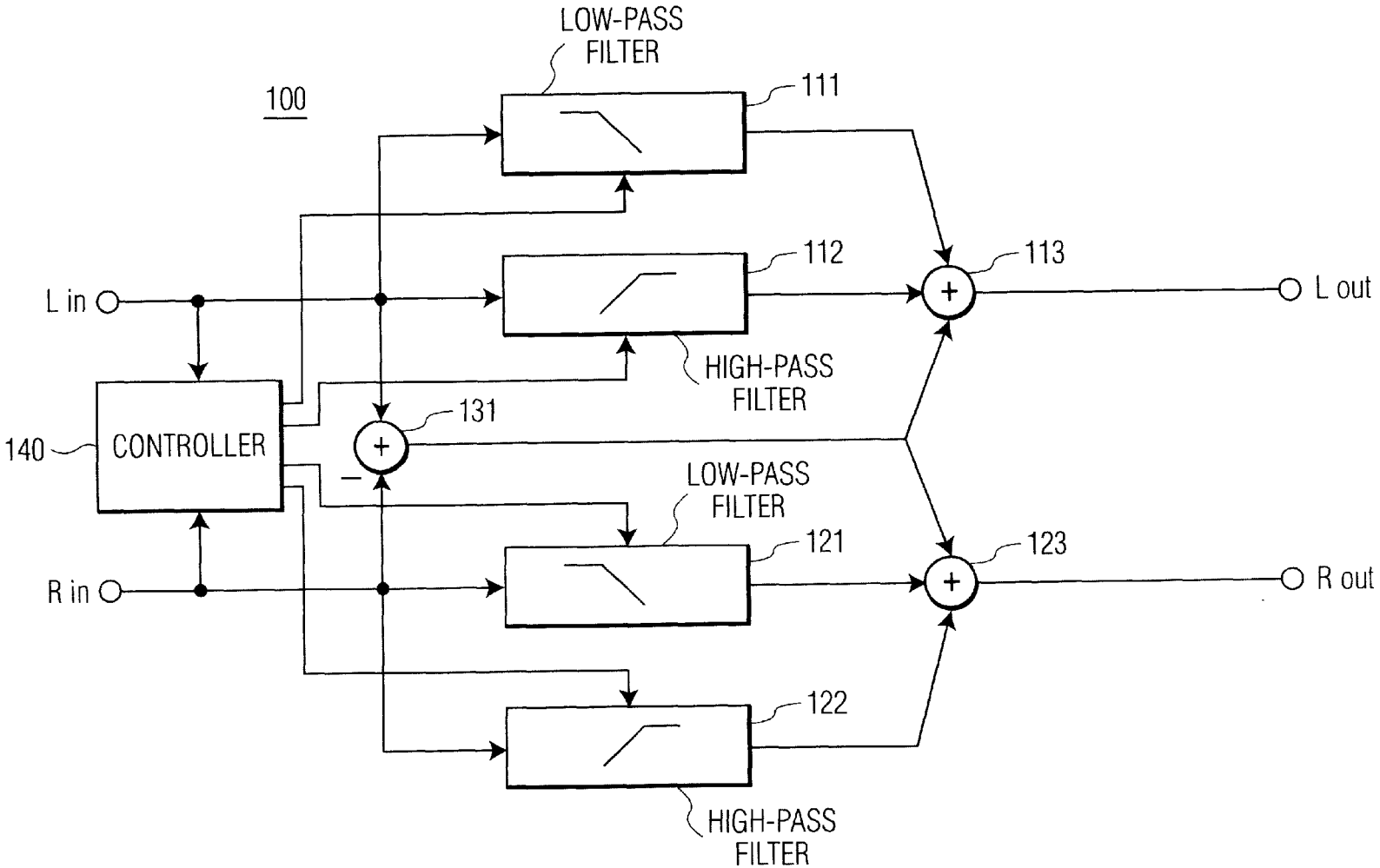
FIG. 1 is a functional block diagram showing the construction of the stereophonic signal processing apparatus according to a first embodiment of the present invention.

Next, a stereophonic signal processing apparatus 100 according to a first embodiment will be described with reference to FIG. 1. In FIG. 1, the stereophonic signal processing apparatus 100 has a left low-pass filter 111 that extracts a left low-frequency signal and a left high-pass filter 112 that extracts a left high-frequency signal, from a left input signal (Lin), a right low-pass filter 121 that extracts a right low-frequency signal and a right high-pass filter 122 that extracts a right high-frequency signal, from a right input signal (Rin), subtraction means 131 that performs a subtraction between the right input signal (Rin) and the left input signal (Lin) to generate a vocal elimination signal, left addition means 113 that adds the left low-frequency signal and the left high-frequency signal to the vocal elimination signal to generate a left output signal (Lout), right addition means 123 that adds the right low-frequency signal and the right high-frequency signal to the vocal elimination signal to generate a right output signal (Rout), and a controller 140 that performs a control to change the characteristics of the respective filters.

The controller 140 performs a control to reduce the attenuation of signals other than the vocal signals included in at least the right input signal and the left input signal, by detecting a rising of a waveform of at least one of the right input signal and the left input signal, or by detecting a frequency component included in at least one of the right input signal and the left input signal.

Then, stereophonic signals as Lin and Rin are inputted. First, subtraction is performed by the subtraction means 131 between the left input signal and the right input signal, and a vocal elimination signal, where the vocal signal precisely located around the center of the stereophonic signal is canceled and various instrumental plays precisely located without the center remain, is generated. In the vocal elimination signal, though the vocal signal is canceled, signal components (instrumental play signals) having different phases from left and right signals remain.

Then the left and right filters extract a low-frequency signal and a high-frequency signal except an intermediate frequency including a vocal signal. At this stage, as the low-frequency signal and the high-frequency signal pass through the filters, though the vocal signals are not included, signal components with the low-frequency and high-frequency regions as the center (instrumental play signals) are extracted as stereophonic signals.

Then, the left addition means 113 adds the left low-frequency signal and the left high-frequency signal to the vocal elimination signal, to generate the left output signal in which all the frequency components are included and the vocal signal is eliminated.

Similarly, the right addition means 123 adds the right low-frequency signal and the right high-frequency signal to the vocal elimination signal, to generate the right output signal in which all the frequency components are included and the vocal signal is eliminated.

In this manner, since the vocal elimination signal is a monophonic signal, to obtain the stereo effect and to enhance the low-frequency and high-frequency regions, stereophonic signals, where all the frequencies are included and the vocal signals are eliminated, are generated by respectively adding the left and right respective low-frequency signals and high-frequency signals to the vocal elimination signal.

Figure 2:
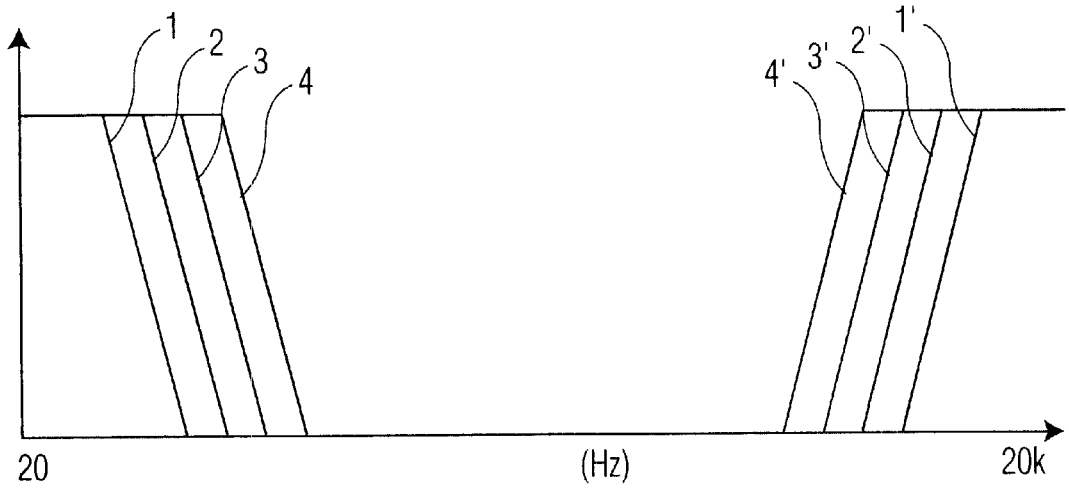
FIG. 2 is a characteristic diagram showing the characteristics of the filters used in the embodiment of the present invention.

Note that low-frequency characteristics of the left low-pass filter 111 and the right low-pass filter 121 in normal times are the same as the conventional characteristics (see 1 in FIG. 2), and high-frequency characteristics of the left high-pass filter 112 and the right high-pass filter 122 in normal times are the same as the conventional characteristics (see 1' in FIG. 2).

Figure 3:
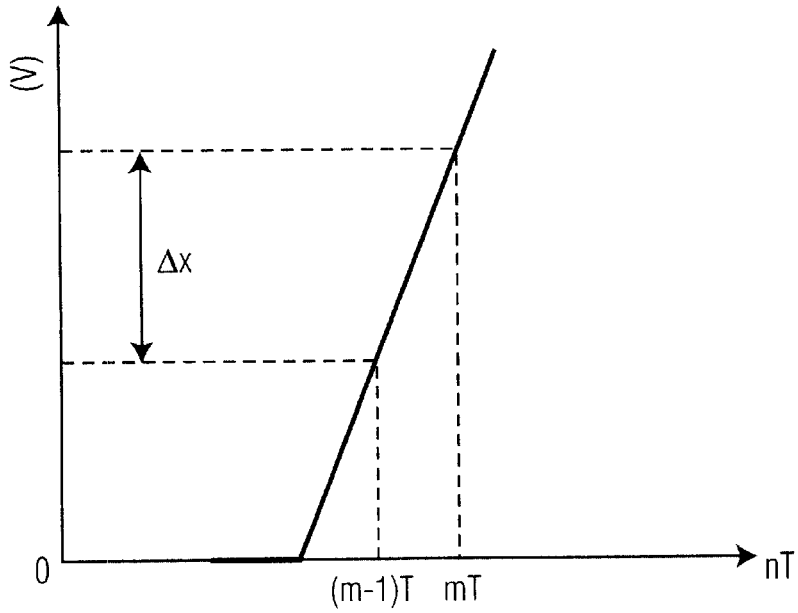
FIG. 3 is a waveform diagram showing the change of input signal as a reference upon filter characteristic change in the embodiment of the present invention.

The controller 140 monitors the rising sharpness $\Delta x$ of input signal (See FIG. 3). In the example shown in FIG. 3, the difference between adjacent sampling timing $(m-1)T$ and sampling timing $mT$ is the rising sharpness $\Delta x$. If the controller detects a rising corresponding to an attack sound of an instrumental play signal mainly having a low-frequency region, it changes both cutoff frequencies of the left and right low-frequency characteristics, in correspondence with the rising sharpness and signal level, to 2, 3 and 4. That is, if the rising is sharper and/or the rising signal level is higher, the cutoff frequencies of the low-frequency characteristics are changed to higher frequencies.

Similarly, the controller 140 changes both cutoff frequencies of left and right high-frequency characteristics, in correspondence with the change of the low-frequency characteristics to 2, 3 and 4, to 2', 3' and 4'. That is, the cutoff frequencies of the high-frequency characteristics are changed to lower frequencies.

For example, in the low-pass filter, the cutoff frequency, which is normally 200 Hz, is changed to 300 Hz, 400 Hz, 500 Hz, and the like, in accordance with an increase in the rising sharpness of input signal. Similarly, in the high-pass filter, the cutoff frequency, which is normally 6 kHz, is changed to 5.5 kHz, 5 kHz, 4.5 kHz, and the like.

Figure 7A:
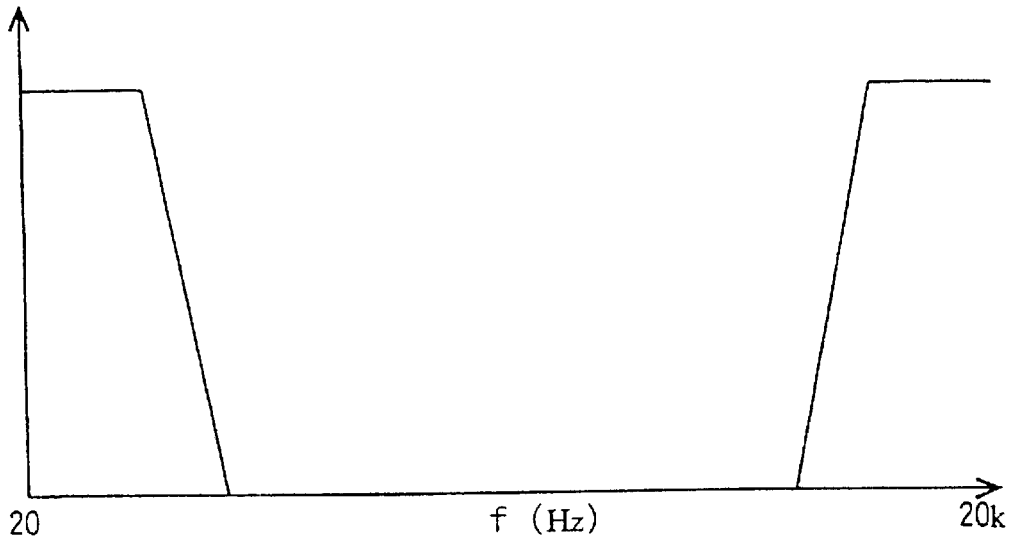
FIGS. 7A and 7B are characteristic diagrams showing the characteristics of the filters used in the conventional stereophonic signal processing apparatus.
Figure 7B:
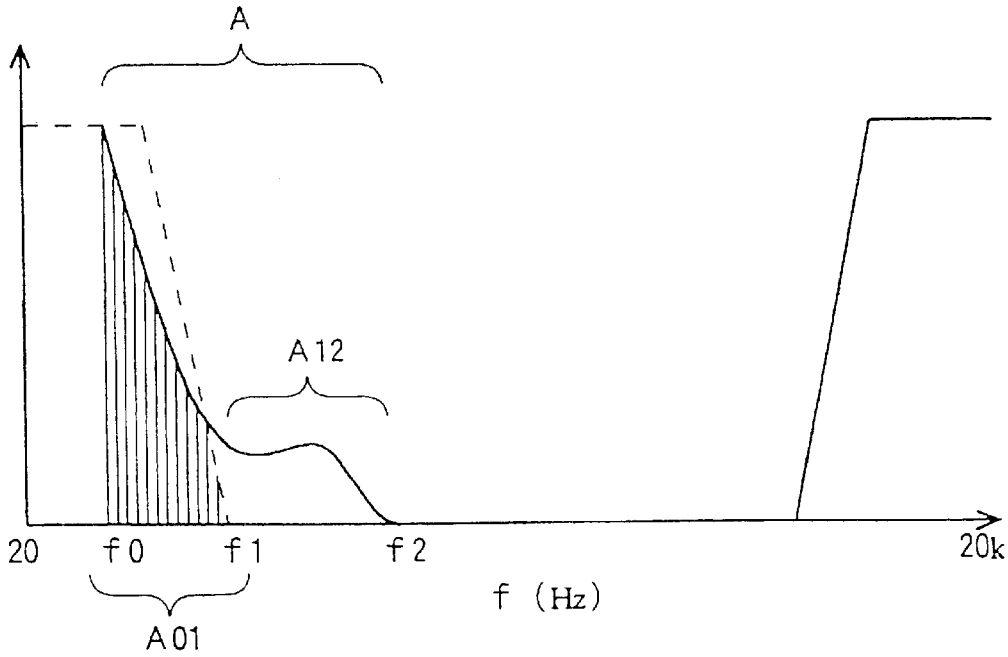

By changing both left and right filter characteristics, the number of frequency components cut by the low-pass filter 111 and the low-pass filter 121 is reduced, and signals of instruments having frequency components as in A in FIG. 7B can be outputted in high fidelity.

Note that actually, as harmonics of considerably high frequencies with respect to a fundamental are included in the low frequency region, high-fidelity signal reproduction can be realized by changing the characteristics of the high-pass filters 112 and 122 as well as the characteristics of the low-pass filters 111 and 121.

Figure 4:
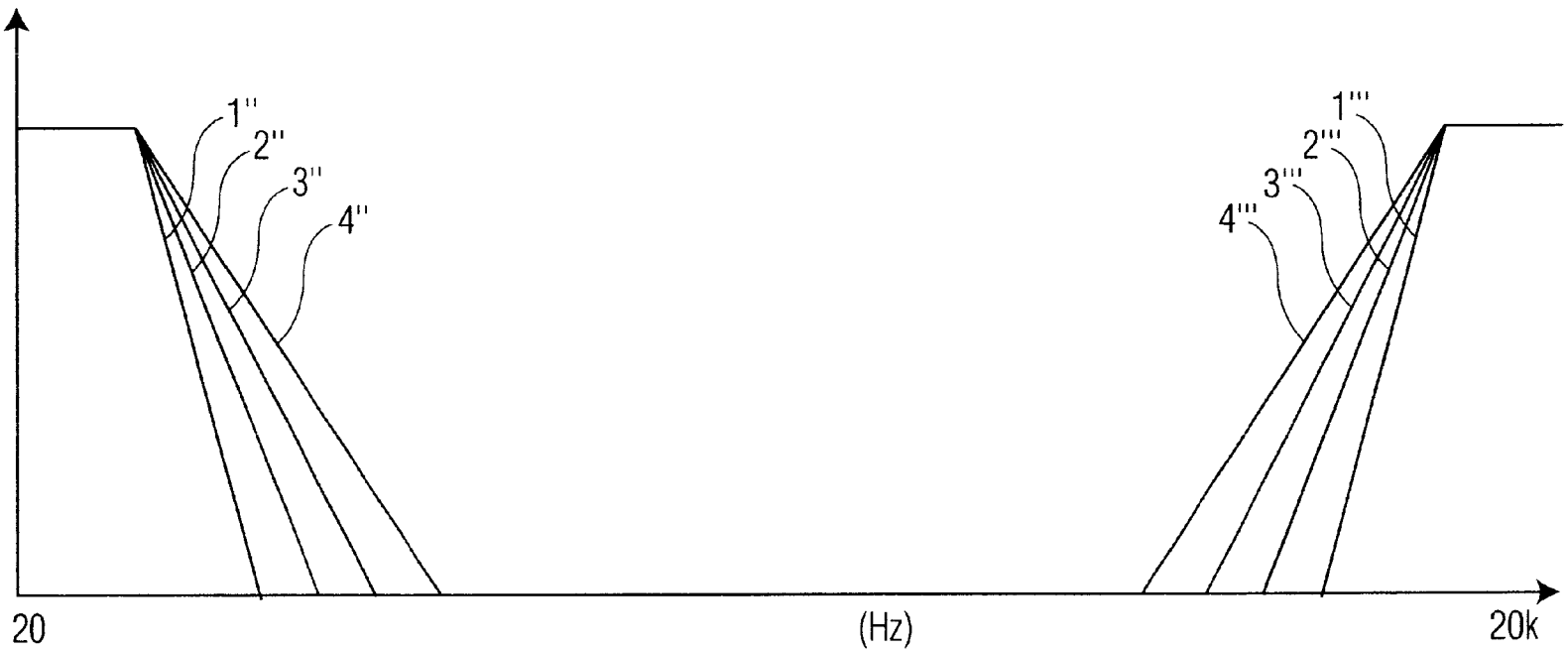
FIG. 4 is a characteristic diagram showing alternate characteristics of the filters used in the embodiment of the present invention.

Further, it may be arranged such that a cutoff characteristic is changed while maintaining a constant cutoff frequency instead of changing the filter cutoff frequency. FIG. 4 shows this arrangement.

In this example, the low-frequency characteristics of the left low-pass filter 111 and the right low-pass filter 121 normally are the same as the conventional characteristics (1" in FIG. 4), and the high-frequency characteristics of the left high-pass filter 112 and the right high-pass filter 122 normally are the same as the conventional characteristics (1'" in FIG. 4).

The controller 140 monitors the rising sharpness Δx of the input signal. If the controller detects a rising corresponding to an attack sound of an instrumental play signal mainly having a low-frequency region, the controller changes the cutoff characteristics of both the left and right low-pass filters 111 and 121, in correspondence with the rising sharpness and signal level, to 2", 3" and 4". That is, if the rising is sharper and/or the rising signal level is higher, the cutoff characteristics of the low-pass filters are changed to milder characteristics. Similarly, the controller 140 changes the cutoff characteristics of both the left and right high-pass filters 112 and 122, in correspondence with the change of the cutoff characteristics of both the left and right low-pass filters 111 and 121, to 2'", 3'" and 4'". That is, the cutoff characteristics of the high-pass filters are changed to milder characteristics.

For example, in the low-pass filter, the characteristic, which is normally −24 dB/oct, is changed to −18 dB/oct, −12 dB/oct, −6 dB/oct, and the like, in accordance with an increase in the rising sharpness of input signal. The characteristic of the high-pass filter is similarly changed.

In this manner, by changing both left and right filter characteristics, the number of frequency components cut by the low-pass filter 111 and the low-pass filter 121 is reduced, and signals of instruments having frequency components as in A in FIG. 7B can be outputted in high fidelity.

The monitoring of the rising sharpness Δx of input signal by the controller 140 can be performed by using the difference between signal levels of input signals at adjacent sampling timings.

Note that as the above control influences a component such as an attack sound, it is desirable that when the filter characteristic is changed from that in normal times, the change is instantaneously made, and when the changed characteristic is changed to the normal characteristic, the change is slowly made. This effectively operates in case of necessity, and restores normal status without an unnatural feeling. Further, it may be arranged such that if the changed status continues for a predetermined period, the normal status is slowly restored. In this case, it may be arranged such that the changed status is maintained for a predicted period where an instrumental attack sound exists, and thereafter, the normal status is restored.

Further, it may be arranged such that plural frequency components are detected in advance, and it is discriminated whether each component is a harmonic component in a low-frequency signal requiring filter characteristic change or a fundamental in an intermediate signal not requiring filter characteristic change.

Note that in the above embodiment, the characteristics of both the low-pass filters and the high-pass filters are changed. However, an excellent result can be obtained by changing only the characteristics of the low-pass filters. Further, it may be arranged such that frequency components included in an input signal are monitored, and the characteristics of one of the low-pass filters and the high-pass filters are changed in accordance with frequency components of instruments, or the low-pass filters and the high-pass filters are controlled to independent characteristics.

Figure 5:
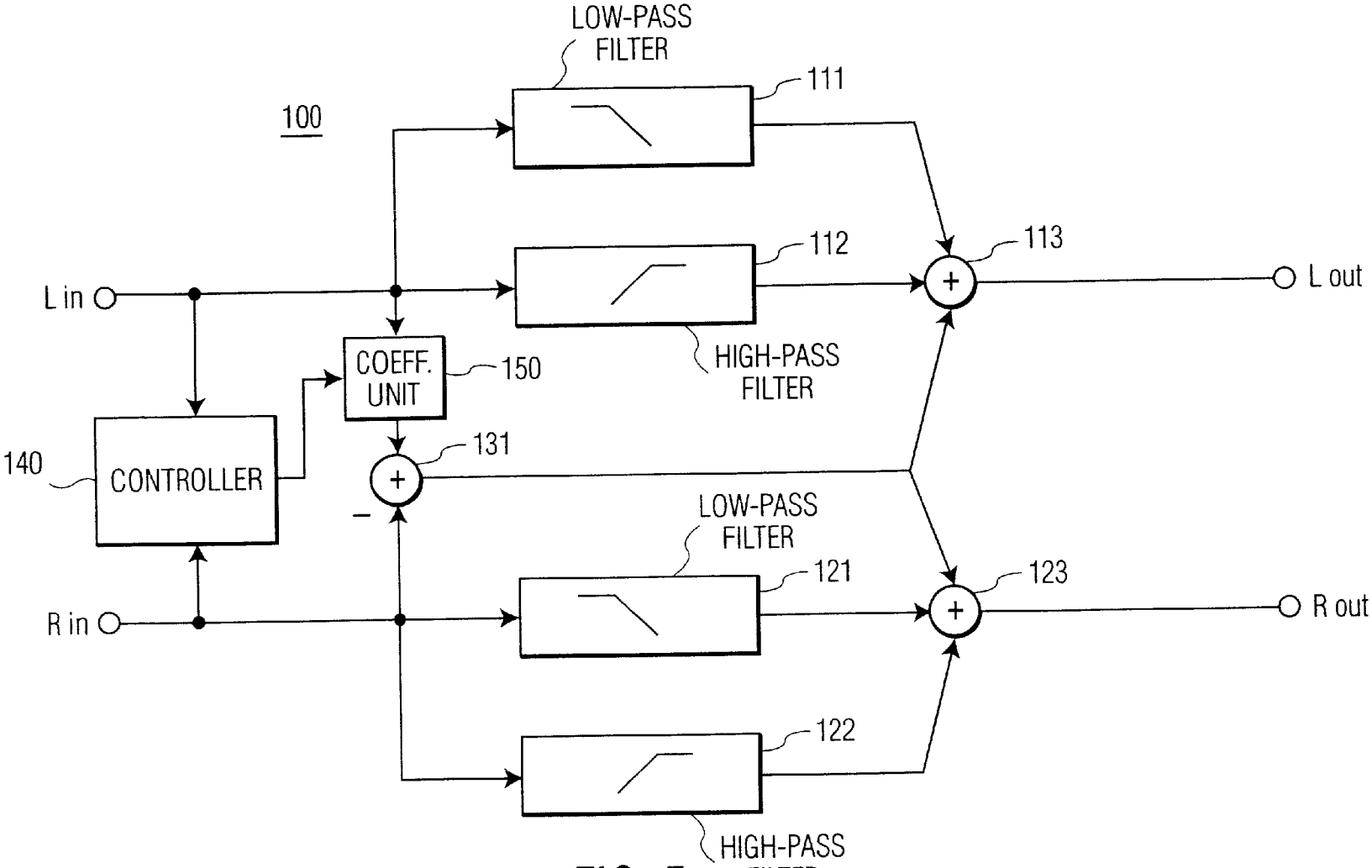
FIG. 5 is a functional block diagram showing the construction of the stereophonic signal processing apparatus according to a second embodiment of the present invention.
Figure 6:
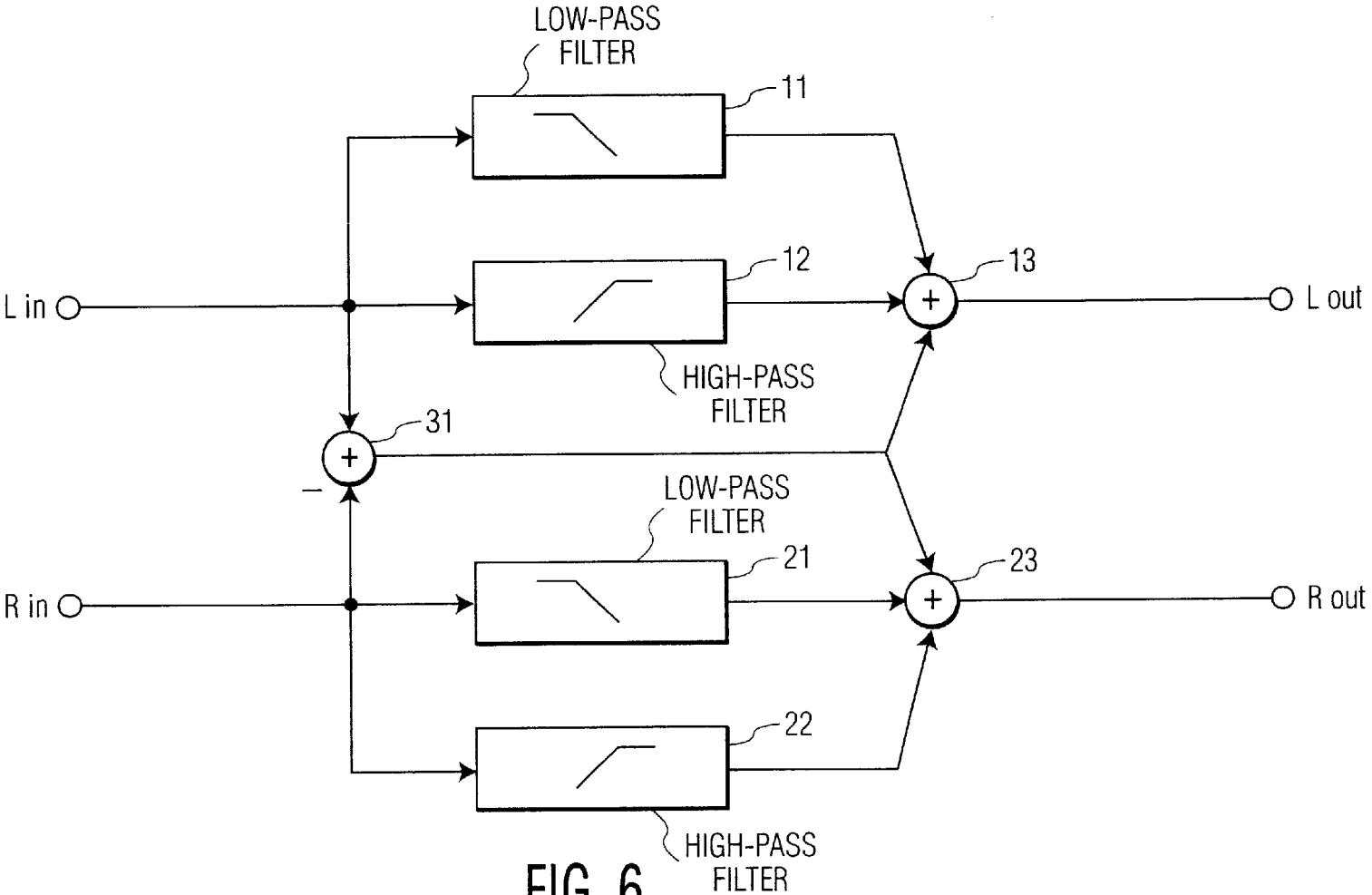
FIG. 6 PRIOR ART
FIG. 6, a block diagram showing the construction of a conventional prior art stereophonic signal processing apparatus.

FIG. 5 is a block diagram showing the construction of the stereophonic signal processing apparatus according to a second embodiment of the present invention. The elements corresponding to those as described in FIG. 1 have the same reference numerals. In this case, the subtraction means 131 has a coefficient unit 150 on the input side on one end, and the coefficient unit 150 is controlled by the controller 140.

As in the case of FIG. 1, since the vocal elimination signal is a monophonic signal, to obtain stereo effect and to enhance the low-frequency and the high-frequency regions, the stereophonic signals, where all the frequency components are included and the vocal signals are eliminated, are generated by respectively adding the left and right respective low-frequency signals and high-frequency signals to the vocal elimination signal.

Note that the controller 140 monitors the rising sharpness Δx of the input signal, and if the controller detects a rising corresponding to an attack sound of an instrumental play signal mainly having a low-frequency region, the controller reduces a coefficient of the coefficient unit 150, in correspondence with the rising sharpness and signal level, to lower than 1 (in normal times).

That is, if the rising is sharper and/or the rising signal level is higher, the coefficient is set to less than 1 (0.7, 0.5, 0.2 or the like), to change the ratio between the left and right input signals, and subtraction is performed.

For example, in case of coefficient 1, complete subtraction is performed, and an unbalance status occurs as the coefficient is gradually reduced, thus even if left and right input signal levels are equal to each other, cancellation is not made.

By this arrangement, the frequency components (A in FIG. 7B), cut by the low-pass filters and the high-pass filters, appear as output from the subtractor 131, and signals of instruments having these frequency components can be outputted in high fidelity.

Note that in this case, the signals of instruments are outputted in high fidelity, and a portion of the vocal component, not eliminated, is also outputted to a certain extent. Accordingly, it is desirable to perform the control such that the coefficient change status (coefficient<1) is maintained for a predicted period where an instrumental attack sound exists, and thereafter, the normal status (coefficient=1) is restored.

Note that in the above first embodiment and the second embodiment, the controller 140 monitors left and right input signals. However, the controller may monitor only one of the input signals.

Further, the first embodiment, which changes the filter characteristic, and the second embodiment, which controls the subtraction rate, may be combined. Such a combination can obtain a further excellent result.

As described in detail with the embodiments, by changing the characteristics of the filter means to enhance low-frequency and high-frequency regions, the attenuation of instrumental sound by the filter means to enhance the low-frequency and high-frequency regions can be reduced while the vocal signals are effectively eliminated. Further, by adjusting signal levels prior to subtraction by the subtraction means for vocal elimination, the attenuation of instrumental sound by the subtraction means is reduced, and high-fidelity reproduction can be realized.

What is claimed is:

1. A stereophonic signal processing apparatus for eliminating vocal signals contained in right and left input signals, said apparatus comprising;

right filter means for extracting a right low-frequency signal and a right high-frequency signal from a right input signal, left filter means for extracting a left low-frequency signal and a left high-frequency signal from a left input signal, a subtraction means for subtracting a right input signal and a left input signal and thereby generating a vocal elimination signal, a right addition means for adding a right low-frequency signal and a right high-frequency signal from said right filter means to a vocal elimination signal from said subtraction means and thereby generating a right output signal, a left addition means for adding a left low-frequency signal and a left high-frequency signal from said left filter means to a vocal elimination signal from said subtraction means and thereby generating a left output signal, and a control means for changing characteristics of both of said right filter means and said left filter means according to at least one of a right input signal and a left input signal.

2. A stereophonic signal processing apparatus for eliminating vocal signals contained in right and left input signals, said apparatus comprising;

right filter means for extracting a right low-frequency signal and a right high-frequency signal from a right input signal, left filter means for extracting a left low-frequency signal and a left high-frequency signal from a right input signal, a subtraction means for subtracting a right input signal and a left input signal and thereby generating a vocal elimination signal a right addition means for adding a right low-frequency signal and a right high-frequency signal from said right filter means to a vocal elimination signal from said subtraction means and thereby generating a right ouput signal, a left addition means for adding a left low-frequency signal and a left high-frequency signal from said left filter means to a vocal elimination signal from said subtraction means and thereby generating a left output signal, and control means for adjusting in signal level a right input signal and a left input signal to be subtracted by said subtraction means according to at least one of a right input signal and a left input signal.

3. A stereophonic signal processing apparatus according to claim 1, wherein;

said control means performs control by detecting the leading edge of waveform of at least one of a right input signal and a left input signal.

4. A stereophonic signal processing apparatus according to claim 1, wherein;

said control means performs control by detecting the frequency component contained in at least one of a right input signal and a left input signal.

5. A stereophonic signal processing apparatus according to claim 1, wherein;

said control means performs control to reduce damping of the other signals than the vocal signals contained in at least one of a right input signal and a left input signal.

* * * * *